US005431390A

United States Patent [19]

Hirose et al.

[11] Patent Number: 5,431,390

[45] Date of Patent: Jul. 11, 1995

[54] SHEET SORTING AND STORING APPARATUS

[75] Inventors: Akira Hirose, Tokyo; Takashi Fujii, Omiya, both of Japan

[73] Assignee: Ricoh Company, Ltd., Tokyo, Japan

[21] Appl. No.: 220,467

[22] Filed: Mar. 31, 1994

Related U.S. Application Data

[63] Continuation of Ser. No. 848,181, Mar. 10, 1992, abandoned.

[30] Foreign Application Priority Data

| | | | |
|---|---|---|---|
| Mar. 12, 1991 | [JP] | Japan | 3-070428 |
| May 1, 1991 | [JP] | Japan | 3-126475 |
| Jun. 3, 1991 | [JP] | Japan | 3-157451 |
| Sep. 30, 1991 | [JP] | Japan | 3-276417 |
| Dec. 20, 1991 | [JP] | Japan | 3-354324 |

[51] Int. Cl.[6] ..... B65H 39/11

[52] U.S. Cl. ..... 271/293; 271/294

[58] Field of Search ..... 271/292, 293, 294; 270/58

[56] References Cited

U.S. PATENT DOCUMENTS

| | | | |
|---|---|---|---|
| 4,433,837 | 2/1984 | Romanowski . | |
| 4,872,663 | 10/1989 | Latone | 271/293 X |
| 4,925,171 | 5/1990 | Kramer | 271/293 X |
| 4,982,948 | 1/1991 | Burger et al. . | |
| 4,984,780 | 1/1991 | Saito | 271/292 |
| 5,035,412 | 7/1991 | Hiroi | 271/294 X |
| 5,048,820 | 9/1991 | Chung | 271/293 |
| 5,112,035 | 5/1992 | Yamamoto | 271/293 X |

FOREIGN PATENT DOCUMENTS

| | | |
|---|---|---|
| 0259829 | 3/1988 | European Pat. Off. . |
| 0301596 | 2/1989 | European Pat. Off. . |
| 0355751 | 2/1990 | European Pat. Off. . |
| 3501250 | 7/1986 | Germany . |
| 56-78769 | 6/1981 | Japan . |
| 57-137263 | 8/1982 | Japan . |
| 61-44787 | 10/1986 | Japan . |
| 2110075 | 4/1990 | Japan . |
| 1531818 | 11/1978 | United Kingdom . |
| 2240328 | 7/1991 | United Kingdom . |

OTHER PUBLICATIONS

Xerox Disclosure Journal, vol. 1, No. 4, p. 61, D. W. Tates, "Sorter with Dual Purpose Tray", Apr., 1976.

*Primary Examiner*—David H. Bollinger

*Attorney, Agent, or Firm*—Oblon, Spivak, McClelland, Maier, & Neustadt

[57] ABSTRACT

A sheet sorting and storing apparatus has a stack of bin trays which are brought open at a sheet reception position, but held close at the other position. The apparatus minimizes noises upon sheet reception in a simple mechanism, improving the efficiency of sheet sorting. The bin trays are inclined down or up depending on a position of a sheet discharge device. A desired bin tray is deviated by a deviation mechanism in an approximately horizontal direction so that a spacing in the direction of the tray inclination is enlarged between two adjacent bin trays located at the sheet reception position, while keeping constant a vertical spacing thereof. The deviation mechanism includes a guide in connection with the bin trays to approximately horizontally deviate them by its slant portion connecting upper and lower vertical slots. Each bin tray has a support on its both sides with parallel surfaces to support the next upper bin tray through rollers disposed between the parallel surfaces of the adjacent bin trays.

22 Claims, 12 Drawing Sheets

SHEET SORTING AND STORING APPARATUS

This application is a continuation of application Ser. No. 07/848,181, filed on Mar. 10, 1992, now abandoned.

BACKGROUND OF THE INVENTION

1. Field of the invention

The present invention relates to a sheet sorting and storing apparatus. More particularly, the present invention relates to a sheet sorting and storing apparatus having a plurality of bin trays for consecutive reception of sheets discharged from an external apparatus like an image forming apparatus such as a copier.

2. Description of the Related Art

In some conventional sheet sorting and storing apparatus, a spacing between bin trays is made enlarged upon sheet discharge to facilitate sheet storage. For example, Japanese Unexamined Patent Publication Sho 57-4855 discloses a sheet jogger/sorter using a Geneva wheel to open a spacing between a determined bin tray and the next upper bin tray to readily receive a discharged sheet thereon. Further, Japanese Unexamined Patent Publication Sho 56-78769 discloses an improved sorter using a helical cam to open a spacing between bin trays similarly.

Another type of conventional sorter is one which does not open a spacing between bin trays to facilitate the sheet reception. For example, Japanese Unexamined Patent Publication Hei 2-110075 discloses a sorting apparatus using a cam in connection with vertical motion of bin trays, to move a desired bin tray for receiving a discharged sheet in parallel with each other so as to form a sheet reception entrance without opening the spacing between the bin trays.

In the apparatus of the former type which opens the bin tray spacing upon sheet reception, a room for sheet storage may be saved because the bin trays are held at a normally unenlarged bin tray spacing except the: sheet receiving bin tray. It is, however, required that a mechanical structure using the Geneva wheel or the helical cam be used in a mechanism for the space opening, which is disadvantageous with respect to a smooth space opening operation. Also, offensive shock noises cannot be avoided in such a mechanism upon the spacing opening operation.

In the latter, the spacing between the bin trays is always kept constant, so that a space opening mechanism is unnecessary and noises may be reduced. It is, however, difficult for such a mechanism to assume a sufficient sheet receiving entrance, causing a problem of sorting or receiving a sheet when bent or curved. Furthermore, if a substantial amount of sheets are expected to stored on the bin trays, all the spacings between the bin trays must be enlarged, which results in increase in scale of the apparatus. This increase in size of the apparatus is contrary to the desire of downsizing. Therefore, the latter mechanism includes an inherent disadvantage to realize both downsizing and sufficient storage amount of sheets.

SUMMARY OF THE INVENTION

It is, therefore, an object of the present invention to provide a sheet sorting and storing apparatus of a simple mechanism and without noises upon sheet receiving operation, solving the above described problems in the conventional apparatus, in which a spacing between bin trays is kept narrow enough to store a desired amount of sheets at a normal position where the sheet receiving operation is not effected, while the spacing between bin trays is opened relatively larger upon the sheet receiving operation to facilitate the sheet storing operation.

The object of the invention can be achieved by a sheet sorting and storing apparatus having a plurality of vertically stacked bin trays each loading face of which is inclined in a direction of sheet discharged out of an external device to receive a discharged sheet therefrom, comprising: a support mechanism for supporting the bin trays movably in an approximately horizontal direction; and a deviation mechanism for approximately horizontally deviating a part of stacked bin trays for a desired bin tray to receive the discharged sheet such that a spacing in the inclination direction of the bin trays is enlarged between the desired bin tray and a next upper bin tray.

The above structure facilitates the sheet reception by such an operation that, upon sorting, the deviation mechanism approximately horizontally deviates the desired bin tray to enlarge the spacing between the bin tray receiving the sheet and the next upper bin tray.

Such an arrangement according to the present invention enables a smooth enlarging operation of bin tray spacing to be effected upon the sheet reception without offensive shock noises, and a sufficiently small bin tray spacing to be held at the normal position when not receiving the sheet. An efficiency of sheet storage may be improved by the arrangement.

The deviation mechanism is preferably a bin tray guide with an inclined guide having an inverted slant with respect to the sheet discharge direction. A portion of the bin trays may be guided by the bin tray guide, following the inverted slant while being approximately horizontally deviated.

In an aspect of the present invention, a vertically moving device is further provided for vertically moving the entire bin trays while keeping constant a vertical relative position between the respective bin trays to cause the deviation mechanism to effect the deviation operation at a fixed position without moving. Since the deviation mechanism effects the deviation of respective bin trays only by the vertical movement of the entire bin trays by means of the vertically moving device, the deviation mechanism may be constructed in a very simple arrangement.

In another aspect of the present invention, each of the bin trays except the uppermost and the lowermost bin trays has a support portion which constructs a part of the support mechanism. The support portion has parallel horizontal support surfaces to support the upper bin trays such that the respective support surfaces support a load of the upper bin trays thereon by coupling with each other. This arrangement allows the deviation mechanism to effect smooth horizontal deviation of the bin trays by such a simple support mechanism.

In a further aspect of the present invention, the support mechanism comprises a support member with a plurality of support surfaces extending along a line between the horizon and a concave curve with respect to the horizon, the support mechanism supporting a load of the upper bin trays such that the support surfaces are coupled with the support portions of the bin trays. The deviation mechanism vertically moves to horizontally deviate the bin trays so as to effect the deviation operation at an unfixed deviation position. In this arrangement, the support and the deviation mechanisms may be constructed in a relatively simple manner.

In a still further aspect of the present invention, the deviation mechanism is a bin tray guide connected to a portion of each bin tray to approximately horizontally guide the bin tray at the sheet entering side thereof. The deviation mechanism of this arrangement is made remarkably simple.

In a still further aspect of the present invention, the deviation mechanism is a bin tray guide with an inclined guide having an inverted slant with respect to the sheet discharge direction. In this arrangement, the deviation may be carried out by the deviation mechanism in a very smooth manner.

In a still further aspect of the present invention, the bin trays have loading faces inclined down from the sheet entrance, and the sheet discharge position is disposed above the desired bin tray to receive the discharged sheet. This arrangement allows the sheet carry mechanism to be simplified and to readily be controlled in driving. This arrangement also reduces problems such as sheet plug or unsuccessful sheet discharge occasionally occurred.

In a still further aspect of the present invention, the support mechanism supports the support portions of respective bin trays through rollers rotationally fit therebetween. This arrangement allows the bin tray under the deviation to approximately horizontally move in an extremely smooth manner.

In a still further aspect of the present invention, the bin trays have loading faces inclined up from the sheet entrance, and the ends of bin trays located below the deviation position are positioned horizontally out with respect to those of the other bin trays located above the deviation position. This arrangement allows one to readily observe the loading face of the bin tray which is to receive the sheet through the difference between their positions.

Another object of the present invention is to provide a sheet sorting and storing apparatus smooth in sheet receiving operation, low in noises, simple in mechanism, inexpensive in production cost, while improving the efficiency of sheet storage, in which a spacing between bin trays is kept narrow enough to store a desired amount of sheets at a normal position where the sheet receiving operation is not effected, while the spacing between bin trays is opened relatively larger upon the sheet receiving operation to facilitate the sheet storing operation.

The other object can be achieved by a sheet sorting and storing apparatus having a plurality of vertically stacked bin trays each loading face of which is inclined in a direction of sheet discharged out of a sheet discharge device to receive a discharged sheet therefrom, comprising: a vertically moving mechanism for vertically moving the bin tray stack in total; a deviation mechanism for approximately horizontally deviating a part of the bin trays in connection with the vertical movement thereof by the vertically moving mechanism such that a spacing in the inclination direction of bin trays is enlarged between two bin trays at and above a fixed sheet discharge position of the sheet discharge mechanism;a support mechanism disposed at both sides of the respective bin trays and having support surfaces parallel to each other, the support mechanism of one bin tray supporting the support mechanism of the next upper bin tray through the respective support surfaces such that a spacing is constant between two support surfaces of adjacent bin trays.

The vertically moving mechanism moves the bin tray stack in total in the vertical direction. When a desired bin tray reaches the deviation position, the deviation mechanism approximately horizontally deviates the bin tray there in connection with the vertical movement of the trays, so that a spacing is enlarged between the bin trays at and above the fixed sheet discharge position to receive the discharged sheet. The support mechanism supports the next upper bin tray through the support surface, keeping the spacing between two support surfaces of the bin tray and the next upper bin tray.

By such arrangement according to the present invention, the deviation of the bin trays may be carried out in a smooth manner, offensive shock noises may be minimized upon the space opening operation between the trays, the mechanism may be simpler and inexpensive in production, and the efficiency of sheet storage may be improved.

Preferably, a rotational member is located between the two support surfaces of support mechanism of adjacent bin trays, whereby the support mechanism of a bin tray supports that of the next upper bin tray through the rotational member. The rotational member facilitates the horizontal movement of the next upper bin tray.

In an aspect of the present invention, a rotational member is located between the two support surfaces of support mechanism of adjacent bin trays. A frictional force may be reduced upon deviation of a bin tray at the deviation position, decreasing a drive load of the deviation mechanism.

In another aspect of the present invention, a groove is provided on at least one of two facing adjacent supports and the bottom of the groove serves as the support surface. The rotational member rotates in the groove upon the deviation, so that the deviation of the bin tray may be achieved without extra guide means in a stable manner.

In a further aspect of the present invention, the rotational member has no fixed rotation axle. Since the friction is a rotational friction of the rotational member upon the deviation of the bin tray in such an arrangement, the drive load of the deviation mechanism may be further reduced.

In a still further aspect of the present invention, the groove and the rotational member have approximately identical sections in their contact area. By this arrangement, the contact area may be maximized between the rotational member and the groove to reduce the contact pressure, so that the elastic deformation or wear may be minimized in the contact area, improving the stability and life of the apparatus.

In a still further aspect of the present invention, the groove has a V-shaped section when cut in its transverse direction. This arrangement effects the self-centering function in cooperation with the rotational member in the v-shaped groove, while keeping small the contact area between the rotational member and the groove. Thus this improves the stability of the apparatus and reduces the drive load of the deviation mechanism.

In a still another aspect of the present invention, the support mechanism further comprises a stopper disposed along a side edge of said groove to partially close the opening thereof and to hold the rotational member therein. This arrangement prevents the rotational member from dropping out of the groove upon assembling or disassembling the bin trays.

In a still further aspect of the present invention, a guide member is provided as a recess to guide the deviation of the bin tray. An excessive drive load of the deviation mechanism may be effectively avoided by the contact between the bin tray and the guide member upon the deviation.

A further object of the present invention is to provide a sheet sorting and storing apparatus, minimizing offensive shock noises and sheet leaping-out from the bin trays upon sheet reception, simple in mechanism, and effective to receive a bent or curved sheet, in which a spacing between bin trays is kept narrow enough to store a desired amount of sheets at a normal position where the sheet receiving operation is not effected, while the spacing between bin trays is opened relatively larger upon the sheet receiving operation to facilitate the sheet storing operation.

The further object of the invention can be achieved by a sheet sorting and storing apparatus having a plurality of vertically stacked bin trays each loading face of which is inclined in a direction of sheet discharged out of an external device to receive a discharged sheet therefrom, comprising: a vertically moving mechanism for vertically moving the bin tray stack in total; a deviation mechanism for approximately horizontally deviating a part of the bin trays in connection with the vertical movement thereof by the vertically moving mechanism such that a spacing in the inclination direction of bin trays is enlarged between two bin trays at and above a sheet discharge position; and a sheet press member vertically extending at sheet entrance side of the bin trays, the tip of the sheet press member standing upright when the corresponding bin tray is at the sheet reception position, but lying towards the loading face of the bin tray at the other position.

In this arrangement, when the vertically moving mechanism reaches the sheet reception position by the vertical movement, the deviation mechanism approximately horizontally deviates the bin tray at the sheet reception to enlarge a spacing between the two bin trays at and above the sheet discharge position to enable the sheet reception on the desired bin tray. The sheet press member contacts with the back of the next upper bin tray and therefore is pressed towards the loading face of the bin tray. The tip of the sheet press member is bent to lie there at the normal position above and below the sheet receiving position. By this, the bending of the sheet may be corrected, so that the sheet is loaded on the bin tray in a flat condition. In the sheet receiving position, the tip of the sheet press member stands upright to prevent the sheet on the bin tray from leaping out thereof.

According to this arrangement, the spacing is enlarged between the bin trays in a smooth manner, and the offensive shock noises may be avoided upon the enlarging operation of bin tray spacing. Also, the sheet press member effectively prevents the sheet leap-out upon reception and corrects the bending of the sheet on the loading face of the tray. Since the bin tray spacing may be minimized, the efficiency of sheet storage is high in this arrangement.

The sheet press member may be a flexible film of elastic material. Such sheet press member is effective and cheep in production in a simple form.

Further objects and advantages of the present invention will be apparent from the following description of the preferred embodiments of the invention as illustrated in the accompanying drawings.

DESCRIPTION OF THE PREFERRED EMBODIMENTS

There will be the preferred embodiments of the present invention below described in detail with reference to the drawings.

Figure 1:
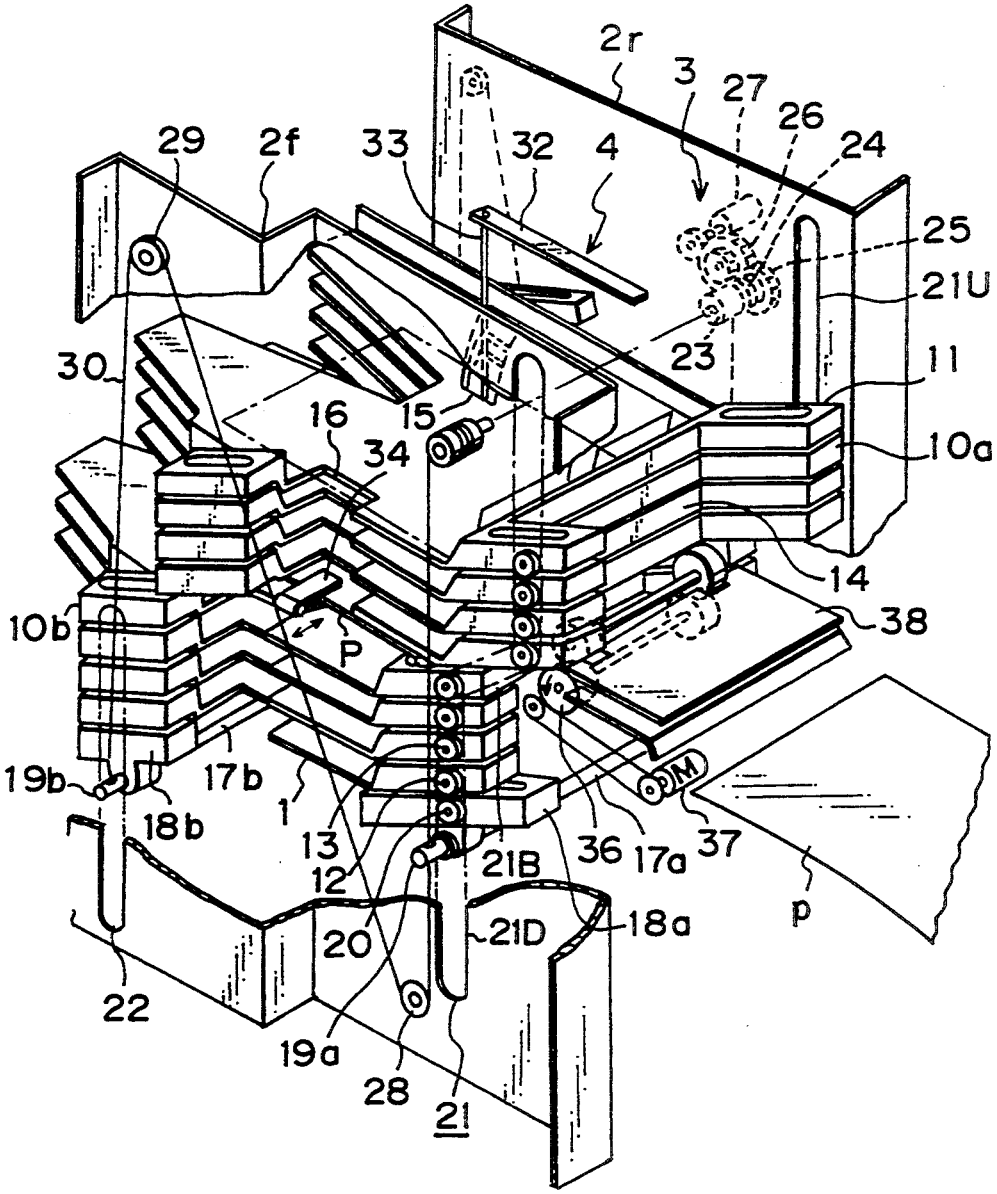
FIG. 1 is a perspective view of the first embodiment of a sheet sorting and storing apparatus according to the present invention.
Figure 2:
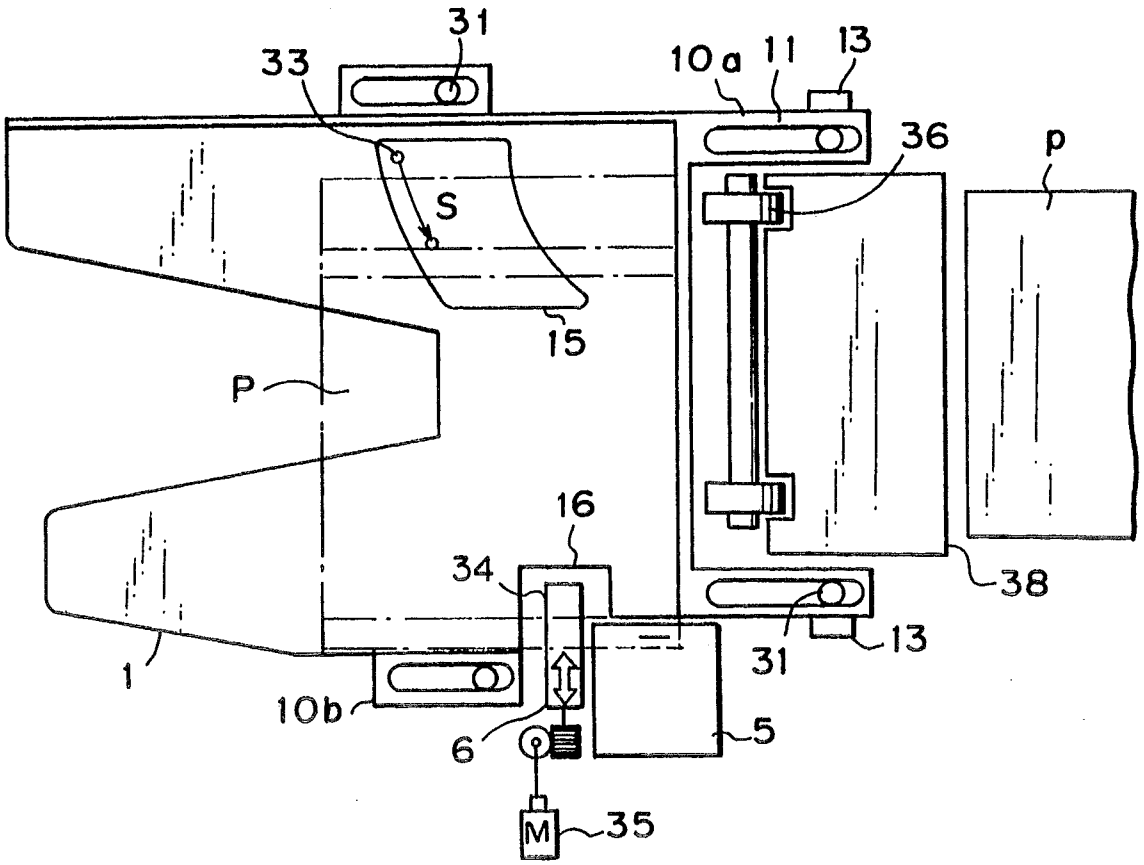
FIG. 2 is a plan view of bin trays and neighboring parts of the sheet sorting and storing apparatus as illustrated in FIG. 1.
Figure 3:
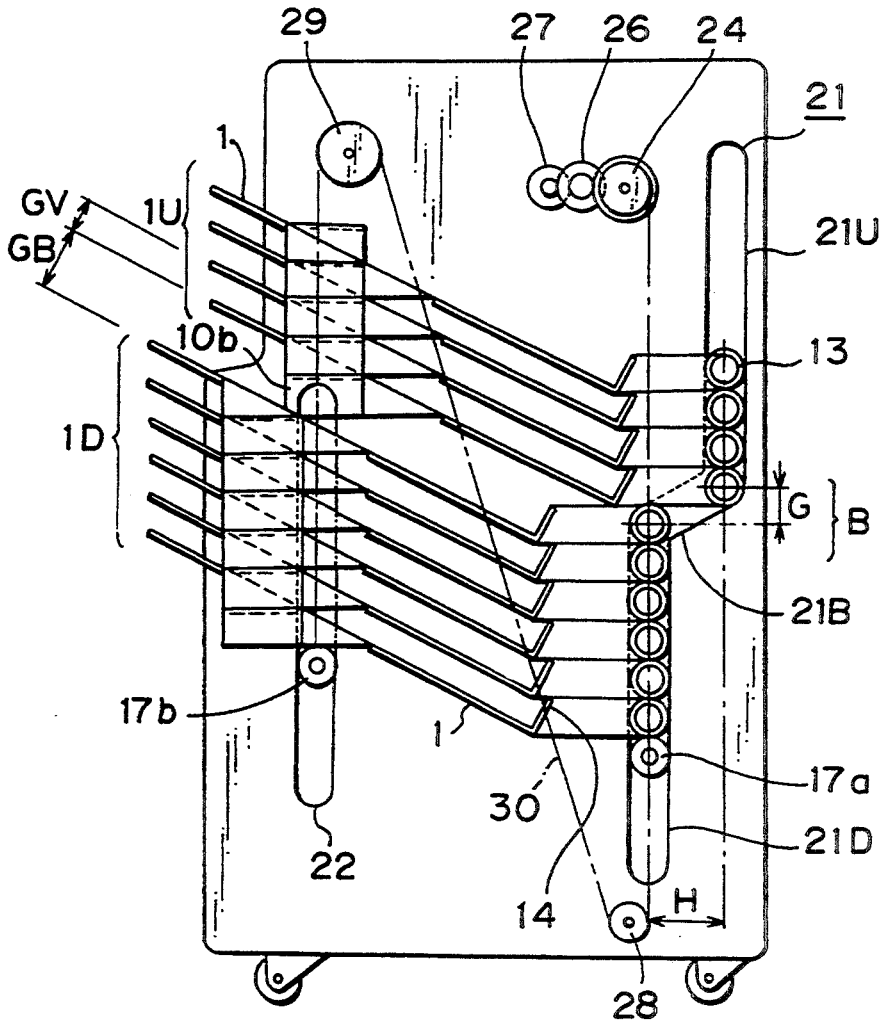
FIG. 3 is a drawing to illustrate deviation of bin trays in the sheet sorting and storing apparatus of FIG. 1.
Figure 4:
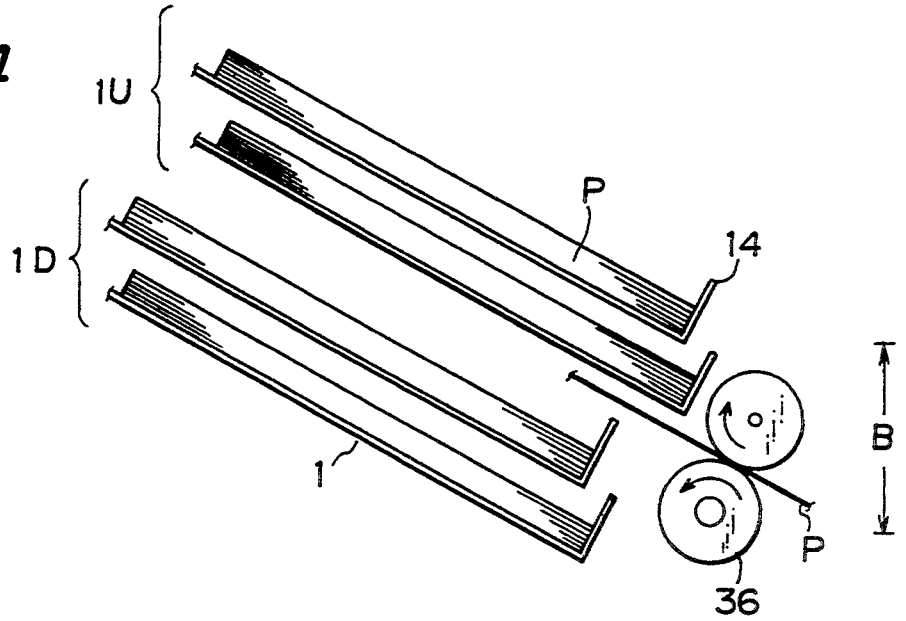
FIG. 4 is an enlarged sectional view of bin trays to illustrate the deviation of bin trays in the apparatus of FIG. 1.

FIG. 1 is a perspective view of the first embodiments of the entire sheet sorting and storing apparatus according to the present invention, FIG. 2 a plan view around bin trays of the apparatus, FIG. 3 a side view of bin trays to illustrate deviation of bin trays in the apparatus, and FIG. 4 a drawing to illustrate the deviation of the bin trays. The sheet sorting and storing apparatus of the preferred embodiments are after-processing apparatus which sort the image recorded sheets discharged from an image forming apparatus such as a copier and staples them to provide a plurality of sets of copied sheets in succession. The sheet sorting and storing apparatus is usually used in close connection with an image forming apparatus next to each other.

The structure of the sheet sorting and storing apparatus will be explained below with reference to FIGS. 1 to 4.

Reference numeral 1 denotes bin trays with sheet loading faces inclined down to the sheet receiving entrance thereof to receive image transferred sheets p carried from the right in the drawings. Numeral 10*a*, 10*b* represent slide cams to hold the bin trays 1 in a stack with each cam having the upper and the lower surfaces in a horizontal condition. A pair of slide cams 10*a* are disposed at the both sides of a bin tray at the sheet entrance side of the apparatus, and another pair of slide cams lob at the both sides of the bin tray near the free end thereof. The multiple bin trays 1 are vertically stacked, and are vertically movable together in the stack condition by means of a vertically moving device. Upon the vertical movement, the respective bin trays 1 move either into the upper stack 1U or into the lower stack 1D by moving a determined distance in the sheet carry direction one by one by a horizontal slide mechanism including later-described cam tracks.

A sheet stapler 5 and a sheet move unit 6 are fixedly mounted near this end of the bin tray 1 located at the lowermost position of the upper stack 1U as shown in FIG. 2. After sorting, the sheet stapler 5 staples an end of the loaded transfer sheets p on tile bin trays 1. The sheet move unit 6 has a pinch mechanism to pinch the transfer sheets p loaded on the bin tray to draw the pinched sheets to the stapling position of the sheet stapler 5 and to return them to the original position thereof.

In the bin tray 1, numeral 11 denotes a lower groove of approximately semi-cylindrical shape extending along the both upper and lower surfaces of the slide cam 10, numeral 13 trunnions fit to rotate on pins 12 projecting out of the both sides of the slide cams 10*a*, numeral 14 a rear end aligning fence formed at sheet receiving side of the bin tray 1 to align the rear ends of the loaded sheets, numeral 15 an opening through which a jogger wire of later-explained jogger 4, and numeral 16 a cut in which the pinch mechanism of the sheet move unit 6 is located. Rollers 31 are fit in the roller grooves 11 between the slide cams 10 of two adjacent bin trays 1.

Next described are a lifting device 3 for vertical movement of bin tray 1 and a horizontal slide mechanism of the bin trays 1. The horizontal slide mechanism moves a bin tray 1 along the slide cams 10, using the vertical driving force of the lifting device 3.

Numerals 2*f*, 2*r* are front and rear frames. The front and rear frames 2*f*, 2*r* have elongated cam tracks 21 near the sheet entrance and vertically elongate guide slots 22 near the free end of the bin tray. Each of the cam tacks 21 is composed of a upper vertical part 21U, a lower vertical part 21D, and a deviation part 21B connecting therebetween. The deviation part 21B is a slant portion gradually inclined down from the sheet receiving side, connecting the upper and the lower vertical parts 21U, 21D. The trunnions 13 of the bin trays 1 and trunnions of a support member of the first bin drive bar as described later are fit in the cam tracks 21 to be guided therealong.

A rotation shaft 23 is supported through bearings above the lower vertical parts 21D of the cam tracks 21. Wind-up pulleys 24 are fixed on the both ends of the rotation shaft 23 outside the front and rear frames 2*f*, 2*r*. A wind-up gear 25 fits on the rotation shaft 23 outside the wind-up pulley 24 at that side in FIG. 2. The wind-up gear 25 is in mesh with a reduction gear 26, constituting a group of meshing gears. A lifting motor 27 is mounted outside the rear frame 2*r* as a power source for the lifting device 3. The drive force of the lifting motor 27 is transmitted to the wind-up gear 25 through the meshing gears. First and second direction change pulleys 28, 29 are journaled below the lower vertical parts 21*d* of the cam tracks 21 and above the guide slots 22, respectively, outside the front and rear frames 21*f*, 21*r*.

Numerals 17*a*, 17*b* represent first and second bin drive bars, and 30 suspension wires. One end of each suspension wire 30 is wound around the wind-up pulley 24. The suspension wires pass through the first and the second direction change pulleys 28, 29, and are then secured at the both ends 19*b* of the second bin drive bar 17*b*. Further, the suspension wires 30 are also secured to the both ends 19*a* of the first bin drive bar 17*a* between the wind-up pulley 24 and the first direction change pulley 28. The suspension wires 30 suspend the stack of bin trays 1 through the first and the second drive bars 17*a*, 17*b* as vertically movable.

First and second support members 18*a*, 18*b* are fixed to the both ends of the first and the second drive bars 17*a*, 17*b* to carry the bin trays 1. The first and second support members 18*a*, 18*b* also have roller grooves 11 on their upper surfaces extending right to left in FIG. 1 and FIG. 3. The support members 18*a*, 18*b* support the bin trays 1 through rollers 31 fit in the roller grooves 11. The first support member 18*a* has pins 20 projecting out on which the trunnions 13 are rotatably mounted. The trunnions 13 of the first support member 18*a* are also fit in the cam tracks 21 as the trunnions 13 of the bin trays 1, moving together upon the vertical movement along the cam tracks 21.

Reference numeral 32 denotes jogger arms rotatable counterclockwise by a drive of an unrepresented drive mechanism, and 33 a jogger wire extending between the jogger arms 32 to hit the rear end of the transfer sheets p stored on the bin tray 1, effecting sheet jogging in cooperation with the other edge of the bin tray 1. The jogger arm 32 and the jogger wire 33 constitute a sheet aligning device or jogger 4 together with the driving mechanism.

Numeral 36 denotes a pair of sheet discharge rollers in an image processing apparatus set before the sheet sorting and storing apparatus, and 38 upper and lower sheet carry guide plates to guide a transfer sheet p discharged from the image processing apparatus, located just before the sheet discharge roller pair 36. The pair of sheet discharge rollers 36 are located at the sheet entrance side of the bin tray 1 in a deviation region B as shown in FIG. 4. The rollers 36 are driven by a sheet discharge motor 37 to discharge an image-formed transfer sheet p through the sheet carry guide plate 38 onto the appointed bin tray 1 (see FIG. 1).

Below described is an operation of the apparatus of the present embodiment.

When a print start button is pressed on an unrepresented image forming apparatus, an image is recorded on a transfer sheet p. The image recorded transfer sheet p is transmitted to the sheet sorting and storing apparatus through the pair of sheet discharge rollers 36. Also, a signal is transmitted from the image forming apparatus to the sheet sorting and storing apparatus to select a determined bin tray 1. After the sheet sorting and storing apparatus receives the signal, the lifting motor 27 rotates by a determined number of rotations clockwise or counterclockwise so as to locate the determined bin tray 1 in the deviation region B, vertically moving the bin trays 1 by the suspension wire 30. The bin trays 1 vertically move up and down by the guide of trunnions 13 mounted on the slide cams 10*a* along the cam tracks 21.

Suppose a bin tray 1 is in the lower stack 1D. The suspension wires 30 lift up the bin trays 1 carried by the first and second support members 18*a*, 18*b* of the first and the second bin drive bars 17*a*, 17*b*, by a necessary distance. When the bin tray 1 reaches the deviation part 21 B of the cam tacks 21 as guided by the rotations of the trunnions 13, the vertical ascending of the bin tray 1 is stopped by the deviation parts 21B inclined towards the sheet receiving side. Then the trunnions 13 move along the slant of the deviation part 21B towards the sheet receiving side. The bin tray 1 horizontally slides in response to the above movement of the trunnions 13 towards the sheet receiving side with the support of the rollers 31 rolling in the roller grooves 11. When the trunnions 13 of the bin tray 1 reach the right upper end of the deviation parts 21B, they are again guided vertically upwards along the upper vertical parts 21U of the cam tracks 21.

By this operation, the trunnions 13 of the bin trays 1 move one by one from the lower vertical part 21D to the upper vertical part 21U, while horizontally moving the bin trays 1 in the deviation region B. Meanwhile, the determined bin tray 1 reaches the deviation region B and the lifting motor 27 stops rotating, so that the determined bin tray 1 may be ready to receive the image transfer sheet thereon. After this operation, the free ends of the upper stack of bin trays 1 located above with respect to the deviation region B are displaced by a horizontal distance H from the free ends of the lower stack of bin trays 1 located below the deviation region B. Therefore, it is easy for one to observe the state of the loading face of the bin tray 1 ready to receive the transfer sheet p in the deviation region B. This is advantageous because one can readily check the image formed condition or the stack condition on the transfer sheet p. In this embodiment, the space enlarging operation between the bin trays 1 in the deviation region B is achieved only by the horizontal displacement of the bin trays 1 caused by the guide of trunnions 13 through the cam tracks 21 in connection with the vertical movement of the bin trays 1. A vertical relation between the bin trays 1 remains unchanged after the deviation. In other words, the vertical spacing G is always maintained constant between the bin trays 1, whereby the slide cams 10 are never separated from each other, serving as support between the bin trays. As seen in FIG. 3, due to the ]horizontal movement of distance H of the bin tray 1 from the lower stack 1D to the upper stack 1U, a spacing GB in the deviation region B is enlarged in correspondence with the vertical movement distance of the bin tray 1 and the slant of the deviation part 21B of the cam track 21, as compared with a spacing GV between the bin trays in the upper stack 1U and in the lower stack 1D.

As described above, the paired sheet discharge rollers 36 are mounted to face the sheet receiving ends of the bin trays 1 in the deviation region B, and the transfer sheet p is discharged through the enlarged spacing GB of the bin trays 1. The sheet discharged from the rollers 36 leans against the rear end aligning fence 14 because of its own weight, aligning its rear end. Although the spacing GB of the bin trays 1 may be more enlarged if the slant angle of the deviation part 21B is smaller, the smaller slant angle would cause a difficulty of movement of trunnions 13 between the lower and the upper vertical part 21D, 21U. On the contrary, if the slant angle of the deviation part 21B is too large, the spacing GB of bin trays 1 in the deviation region B would not be sufficient. Therefore, the slant angle should be determined considering the both conditions. After the rear ends of the transfer sheet are aligned, the jogger 4 starts its operation. The jogger arm 32 swings counterclockwise by a predetermined angle as shown by an arrow s in FIG. 2, so that the jogger wire 33 horizontally moves in the opening 15, drawing an arch s to hit that ends of the transfer sheets p stored on the bin tray 1 so as to effect the sheet aligning. By this aligning, the transfer sheets p are urged against the ends of each of the bin tray 1 aligning this ends of the sheets.

If another signal is transmitted to the sheet sorting and storing apparatus to assign the next bin tray in response to the next sheet discharge of transfer sheet p from the image forming apparatus, the lifting motor 27 rotates necessary times to lift up the first and the second bin drive bars 17*a*, 17*b*, which brings the uppermost bin tray in the lower stack 1D into the lowermost position in the upper stack 1U. By this lift-up operation of the bin trays 1 by the lifting device, the enlarged spacing GB is formed between the before-uppermost bin tray in the lower stack 1D and the next lower bin tray. Also the spacing will be the narrow spacing GB between the before-uppermost bin tray in the lower stack 1D and the before-lowermost bin tray in the upper stack 1U. If the transfer sheet is curved or if a substantial amount of transfer sheets have been loaded on the bin tray 1, the before-lowermost bin tray in the upper stack 1U would press the transfer sheets p on the next bin tray to correct the curvature or to reduce the thickness of the loaded sheets.

As described, the sorting operation will be completed by the intermittent lifting operations of the bin trays 1 by the lifting device 3 and the receiving operation of the transfer sheets p from the image forming apparatus onto the bin tray 1. After the completion of the sorting, if the sorting and the storing apparatus receives a command to perform stapling operation of the sheets from the image forming apparatus, the sorting and storing apparatus will proceed the stapling operation by the stapler 5 as follows.

First, the lifting motor 27 rotates to move the bin trays 1 up or down to bring the uppermost bin tray which carries the transfer sheets p to the lowermost position in the upper stack 1U. At the position, the pinch pieces 34 of the sheet move unit 6 are actuated by the sheet move motor 35 to enter the cut 16 of the bin tray 1, opening their free ends. Then the pinch pieces 34 close their free ends to pinch the transfer sheets p and draw them to the stapler 5 to effect the stapling at a corner of the transfer sheets while holding the sheets. After the stapling on the transfer sheets p, the sheet move motor 35 reversely rotates to return the transfer sheets p to the initial position. The sheet stapler 5 and the sheet move unit 6 may be constructed using the conventional techniques. Therefore, details of the stapler 5 and the unit 6 are omitted.

In this embodiment, the suspension wire is employed for the lifting device of the bin trays 1, but other lifting devices may be employed. Also, the rollers 31 are not essential. A pair of recess and protrusion will do for the purpose between the upper and the lower surfaces of the cam tracks 10, Further, the rollers 31 are balls in this embodiment, but they may be replaced by cylinders. Furthermore, the jogger wire for the transfer sheet jogging on the bin tray 1 may be substituted by a jogger bar of rod.

Next described is the second embodiment of the sheet sorting and storing apparatus according to the present invention.

The second embodiment is essentially the same as the first embodiment in that a stack of bin trays 1 inclined towards the sheet entrance are horizontally deviated in a deviation region B to enlarge a spacing between the bin trays 1 at the normal position into a larger spacing GB. However, it is different from the first embodiment in that respective bin trays 1 are arranged only to horizontally move and that the deviation of the bin trays 1 is conducted by a deviation block vertically moving near the sheet entrance side of the bin trays.

Figure 6:
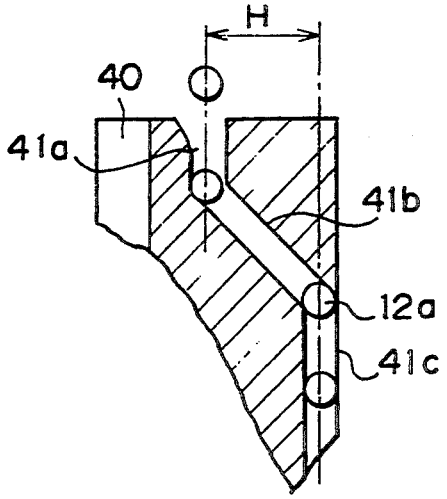
FIG. 6 is a partial sectional view of a deviation block in the apparatus as shown in FIG. 5.
Figure 7:
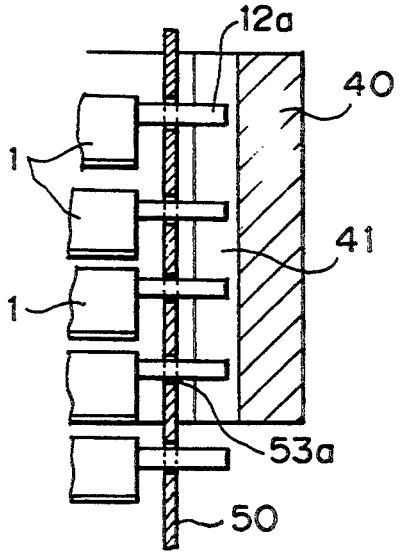
FIG. 7 is a vertical section of the deviation block and side panel, perpendicular to the section of FIG. 6.
Figure 5:
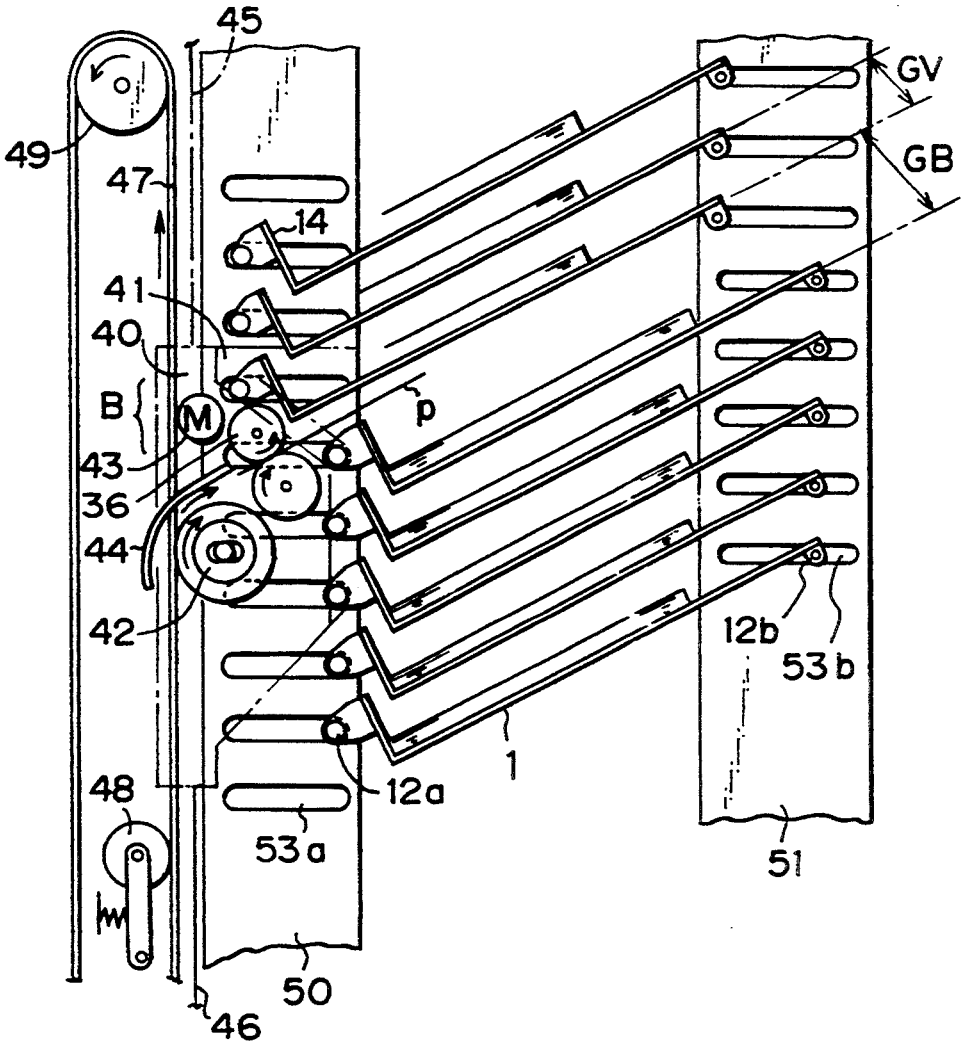
FIG. 5 is a schematic drawing of the second embodiment of the sheet sorting and storing apparatus according to the present invention.

FIG. 5 is a drawing to illustrate the second embodiment of the sheet sorting and storing apparatus, FIG. 6 a vertical section of main part of the deviation block to deviate the bin trays 1, and FIG. 7 a vertical section of deviation block and a side panel of the apparatus, cut through a guide slot of the deviation block. The same parts as in the first embodiment are denoted by the same reference numerals as in the first embodiment, and details of these parts are omitted. The reference numerals will be used with consistency throughout the specification to simplify the explanation. The second embodiment will be explained with reference to FIGS. 5–7.

Reference numerals 50, 51 denote right and left side panels vertically extending at this and that sides in FIG. 5. Four pins 12*a*, 12*b* project out from the side edges of each bin tray 1. There are a number of elongate slots 53*a*, 53*b* on the side panels 50, 51 horizontally extending in parallel with each other. The side panels 50, 51 of this side also have such numerous elongate slots. The pins 12*a*, 12*b* are freely fit in the elongate slots 58*a*, 53*b*, whereby they are supported by the lower edges of the elongate slots 53*a*, 53*b*. Therefore, the bin trays 1 are supported through the pins 12*a*, 12*b* by the lower edges of elongate slots 53*a*, 53*b*. Since the pins 12*a*, 12*b* are freely supported in the elongate slots 53*a*, 53*b*, the bin trays 1 may slide right or left in FIG. 5 when a horizontal external force is loaded on the bin tray. The deviation block 40 is vertically movably suspended by a wire 45 at the sheet entrance side of the bin trays 1 as bridging between the side panels 50 at this and that sides. The deviation block 40 has two side portions at this and that sides in FIG. 5 to cover the left side panels 50. The side portions of the deviation block 40 have respective guide grooves 41 recessed to receive the pins 12*a*. The guide grooves 41 guide the pins 12 of the bin trays 1 to deviate the bin trays. There are a pair of sheet discharge rollers 36 to discharge a transfer sheet p, located between the side portions of the deviation block 40. A wind-up roller 42 is also located between the side portions of the deviation block 40. The wind-up roller 42 works with a sheet carry belt 47 between upper and lower drive rollers 49. The carry belt 47 circulates between the drive rollers 49 to carry the transfer sheet p. The wind-up roller 42 winds up a guide sheet 46 of flexible material such as polyesters to guide the transfer sheet p while contacting or approaching the carry belt 47.

One end of the guide sheet 46 withdrawn therefrom is fixed to the lower frame not shown, while the other end thereof is attached to the circumference of the wind-up roller 42. The wind-up roller 42 is journaled on a support axis and urged by an unrepresented coil spring in the direction of wind-up of the guide sheet 46. A guide plate 44 is disposed above the wind-up roller 42 to separate the transfer sheet p carried by the carry belt 47 and then to guide the separated sheet to a nip part of the sheet discharge rollers 36. Numeral 48 denotes a biasing roller biasing the carry belt 47 towards the guide sheet 46 to help carry the transfer sheet.

When the print start button is pressed, the image forming apparatus forms an image on a transfer sheet p and transmits the recorded sheet to the sheet sorting and storing apparatus. The image forming apparatus also transmits a sort start signal and a start bin tray assigning signal to the sheet sorting and storing apparatus. The sheet sorting and storing apparatus starts sorting upon reception of the signals. The carry belt 47 starts circulating, the biasing roller 48 is biased towards the carry belt 47, the sheet discharge motor 43 driving the paired sheet discharge rollers starts rotating, and the deviation block 40 starts the vertical movement to bring the assigned bin tray 1 to the position facing the paired rollers 36 in response to the start bin tray assigning signal.

The above vertical movement of the deviation block 40 causes the following deviation of the bin trays 1. The deviation block 40 starts moving up from the lower standby position and moves to a position of the elongate slots 53*a* in which the left pins 12*a* of the bin tray 1 located at the lowermost are fit. The pins 12*a* sitting at the left ends of the elongate slots 53*a* enter the upper opening of the guide grooves 41 on the upper face of the deviation block. The entered pins 12*a* are guided by the guide grooves 41 such that they pass through the upper guide groove 41*a* vertically extending down from tile upper opening of the guide grooves 41, then through the slant guide groove 41*b* (deviation region B) inclined down from the lower end of the upper guide groove 41*a*, and then through the lower guide groove 41*c* again vertically extending down from the lower end of the slant guide groove 41*b* as shown in FIG. 6. By the guide of the pins 12*a* through the guide grooves 41, the pins 12*a* slide from the left end to the right end of the elongate slots 53*a*, whereby the bin trays 1 on which the pins 12*a* are attached are also deviated horizontally to the right in FIG. 5.

When the assigned bin tray reaches the sheet discharge part of the sheet discharge rollers 36 based on the start bin tray assigning signal, where the upper edge of the rear end aligning fence 14 opposes to the rollers 36, the upwards vertical movement of the deviation block 40 is stopped to wait the carry of the transfer sheet through the entrance. The transfer sheet p is carried by the carry belt 47 with the guide of the guided sheet 46 to the stopping deviation block 40, and is separated from the carry belt 47 by the guide belt 44 to be transmitted towards the nip part of the sheet discharge rollers 36.

In this embodiment, the deviation of the bin trays through the guide of the pins 12*a* by the guide grooves 41 causes the spacing GV at the normal position between the assigned bin tray and the next upper bin tray to be enlarged into the spacing GB in the deviation region B as in the first embodiment. A possibly slightly bent or curved transfer sheet p through the sheet discharge rollers 36 may be loaded on the assigned bin tray 1 without interference from the next upper bin tray and the rear end aligning fence 14 of its own because of the enlarged spacing. Repeated sorting thereafter will be the same as in the first embodiment. Similarly, while the deviation block 40 moves down, the pins 12*a* move backwards in the guide grooves 41, keeping the spacing GB enlarged between the bin tray in the deviation region B and the next upper bin tray.

As described above, the deviation of the bin tray 1 is effected by the vertical movement of the deviation block 40 without moving the whole bin trays. This arrangement allows simplification of the deviation mechanism in the sheet sorting and storing apparatus. The apparatus may be manufactured as inexpensive in cost, compact in shape, and less in noises.

The elongate slots 53*a*, 53*b* on the side panels 50, 51 have the horizontal upper and lower edges. The elongate slots 53*a*, 53*b* may be, however, curved such that the left and the right ends thereof are down the center of the slots to provide stable positions for the pins 12*a*, 12*b*. In this embodiment, the pins 12*a*, 12*b* are slidable between the left and the right ends of the elongate slots 53*a*, 53*b*. Also, rollers may be employed to fit on the pins 12*a*, 12*b* to reduce a friction upon the movement, such that the rollers rotate in the elongate slots 53*a*, 53*b*.

Below described is the third embodiment of the sheet sorting and storing apparatus according to the present invention.

Also in the third embodiment, a stack of bin trays 1 are mounted to horizontally move in a deviation region B, such that the spacing GV between two bit trays 1 in the normal position is enlarged to a spacing GB in the deviation region B, as in the second embodiment. However, the bin trays 1 are inclined down from the sheet entrance inverted from those in the first and the second embodiments. An initial velocity of the transfer sheet p upon discharge from the sheet discharge rollers 36 is set relatively slower than those in the first and the second embodiments.

Figure 8:
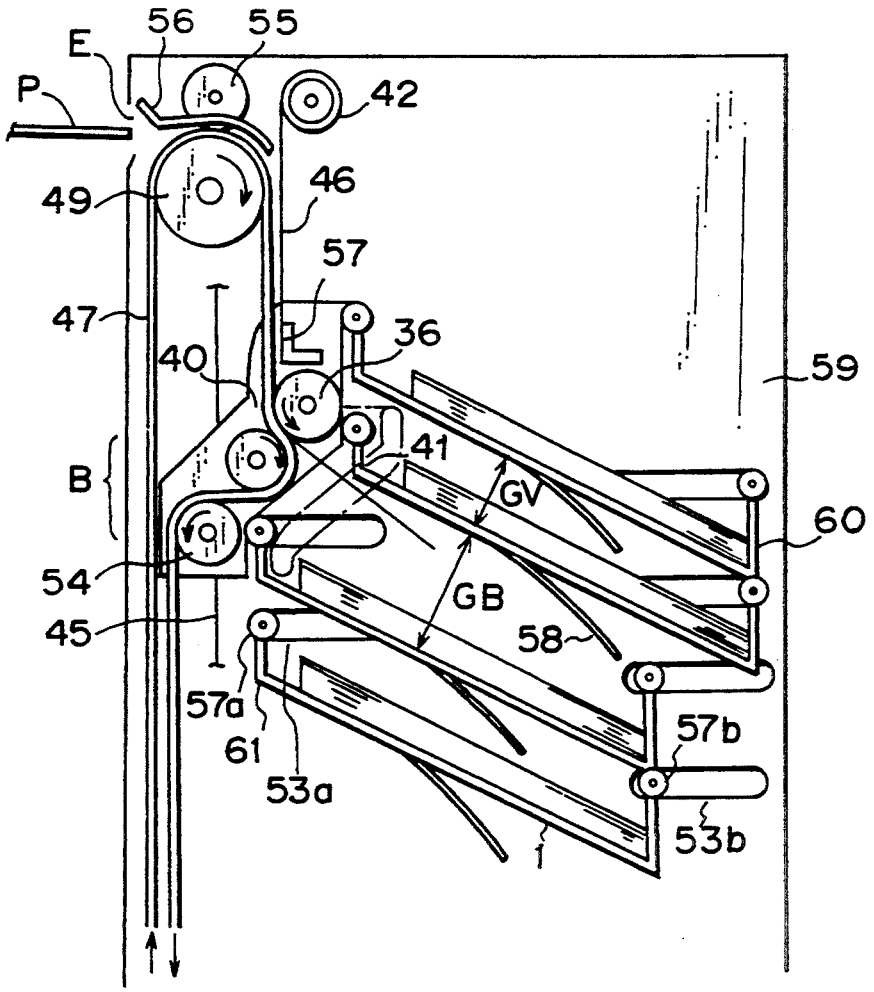
FIG. 8 is a schematic view of the third embodiment of the sheet sorting and storing apparatus according to the present invention.

FIG. 8 is a drawing to show a simplified structure of the third embodiment of the sheet sorting and storing apparatus according to the present invention. The structure and operation of this embodiment will be explained below.

In FIG. 8, a transfer sheet p is discharged from an unrepresented copier arranged next to the sheet sorting and storing apparatus and enters the sheet entrance E. The transfer sheet is guided by the upper guide plate 56 and brought into the apparatus, while pinched between a carry belt 47 driven by a drive roller 49 and a press roller 55. The transfer sheet p is further guided downward by a guide sheet 46 and carried by the carry belt 47 to a nip part of paired sheet discharge roller 36. The circulating carry belt 47 passes between the sheet discharge rollers 36, partly winds the lower roller while providing a rotational driving force therewith, and then contacts with a belt biasing roller 54 changing its path from the horizontal to the vertical direction.

A deviation block 40 rotatably supporting the sheet discharge roller 36 and the belt biasing roller 54 thereon bridges between an unrepresented front and rear frames 59, and is vertically movably suspended by a wire 45. The deviation block 40 has two sides facing the front and rear frames 59 on this and that sides in FIG. 8. The sides of the deviation block 40 have guide grooves 41, respectively, which are coupled with left bin guide rollers 57*a* on the bin trays 1 to enable the deviation of the bin trays 1. A wind-up roller 42 for winding up the guide sheet 46 is journaled between the front and rear frames 59, and the withdrawn end of the guide sheet 46 is fixed to a stopper 57 on the deviation block 40.

The bin trays 1 have main loading faces inclined down towards their free ends, and, upper fence 61 and lower fence 60 forming end walls at the respective ends. The standing upper lower fences 61, 60 have left and right bin guide rollers 57*a*, 57*b* at the both sides on the upper edge thereof, the left and the right bin guide roller 57*a*, 57*b* being freely rotatably mounted on pins projecting out of the fences 60, 61. The front and rear frames have horizontally extending slots, or, left and right guide slots 53*a*, 53*b* corresponding to the left and right pin guide rollers 57*a*, 57*b*. The left and right pin guide rollers 57*a*, 57*b* fit in the left and right guide slots 53*a*, 53*b* to be horizontally rotatably supported therein. By this arrangement, the respective bin trays 1 may horizontally move through the rotation of the rollers 57*a*, 57*b* maintaining a determined angle of the main load faces with respect to the horizon. Reference numeral 58 denotes a leap-out inhibitor to inhibit the transfer sheet p discharged on the bin tray 1 from leaping out over the lower fence 60 upon dropping towards the loading face of bin tray 1.

The left pin guide rollers 57*a* have a determined axial length to fit in the left guide slots 53*a* and to enter the guide grooves 41 on the deviation block 40 while the deviation block 40 moves vertically. The rollers 57*a* enter the guide grooves 41 upon the vertical movement of the deviation block 40 and are guided by the guide grooves 41 to horizontally move in the left guide grooves 41, whereby deviating the bin trays 1. In this embodiment, the sheet discharging part of the sheet discharge rollers 36 on the deviation block 40 is located above the bin tray 1 at the uppermost position in the lower stack 10 having the enlarged spacing GB in the deviation part B. And the sheet discharge part of the rollers 38 is beyond the upper fence 61 as well. The arrangement as in the first and the second embodiments requires a high speed discharge of the transfer sheet p onto the relatively distant bin tray 1 by rotating the sheet discharge rollers 36 at a high speed to provide a high initial velocity with the transfer sheet p. In contrast, the arrangement of the third embodiment does not require such high speed initial velocity for the secure sheet discharge. Therefore, the sheet discharge rollers 36 of the third embodiment have a rotational speed just for maintaining the same speed as the carry speed of the carry belt 47, which is easier in drive control of the sheet carrying device. Also the mechanism for the sheet carry may be simplified so that accidental troubles such as sheet plug or unsuccessful sheet discharge may be minimized to occur.

Figure 9:
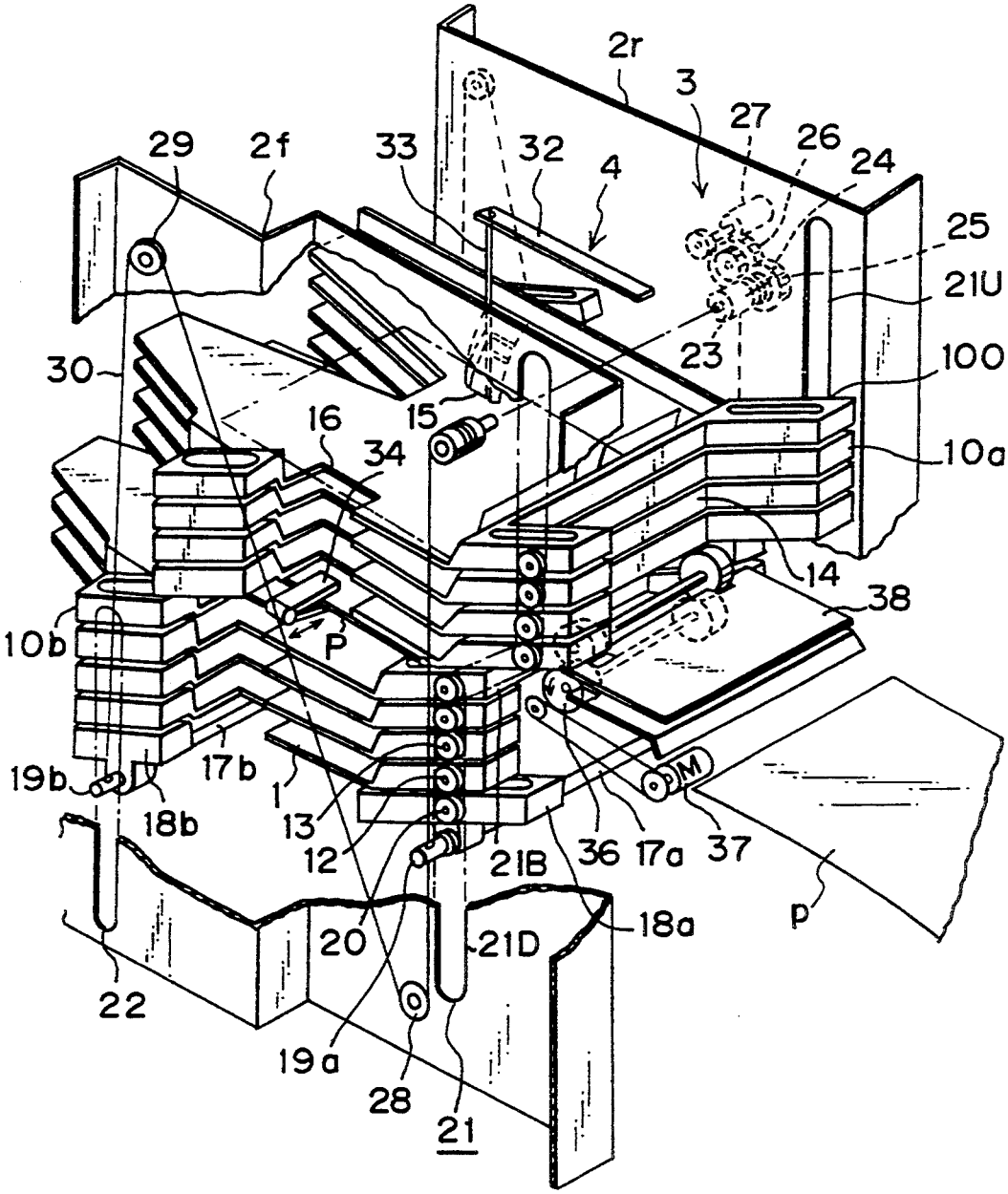
FIG. 9 is a ,partially broken perspective view of the fourth embodiment of the sheet sorting and storing apparatus according to the present invention.
Figure 10:
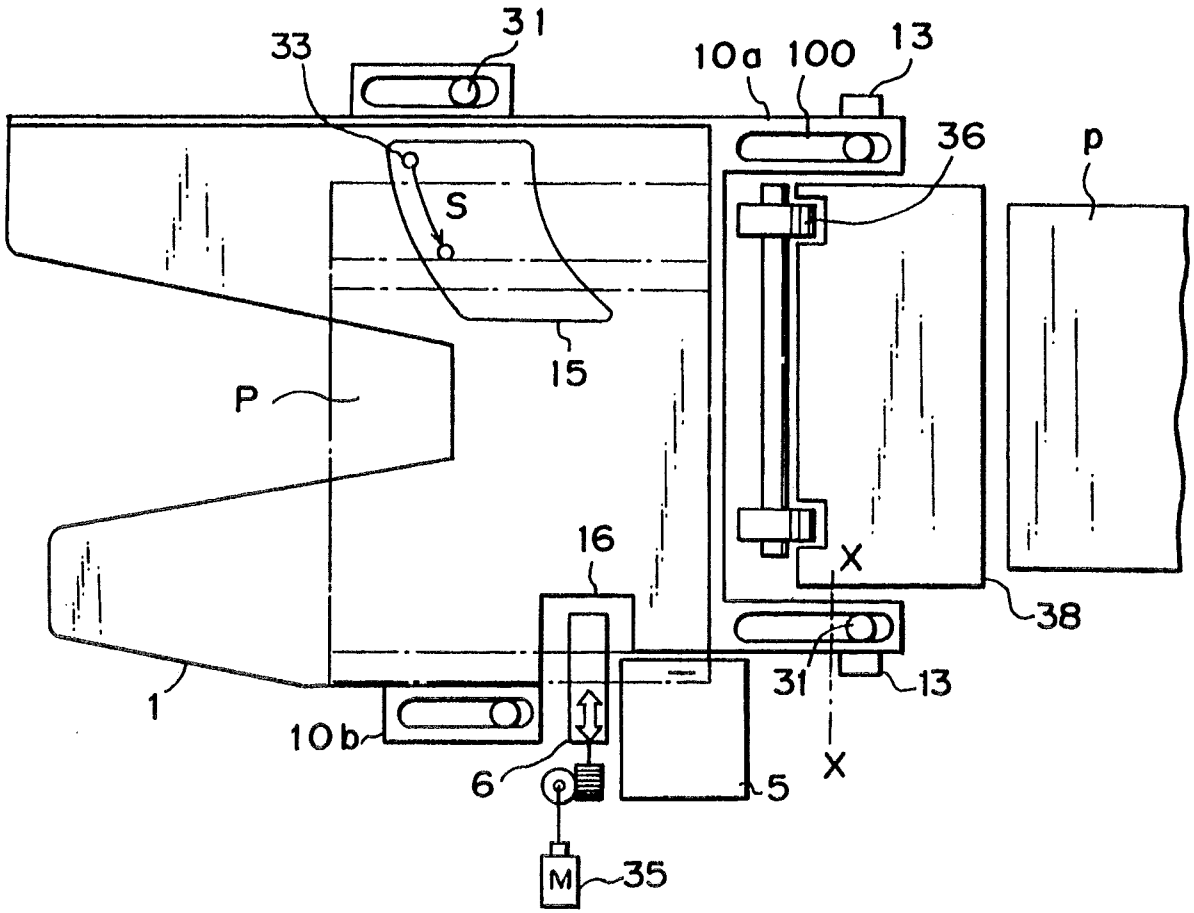
FIG. 10 is a plan view of bin trays and neighboring parts of the apparatus as shown in FIG. 9.
Figure 11:
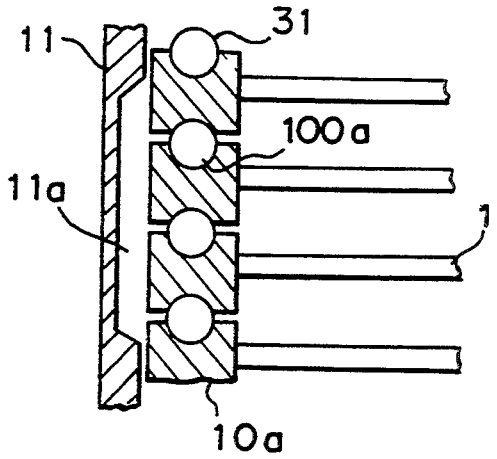
FIG. 11 is a vertical section of bin trays of the fourth embodiment along a line X—X as shown in FIG. 10.

Next described is the fourth embodiment of the sheet sorting and storing apparatus according to the present invention with reference to FIGS. 9–11. The same elements as in the first embodiment as shown in FIGS. 1–4 are given the same reference numerals and details of these elements are omitted.

FIG. 9 is a partially broken perspective view of the sheet sorting and storing apparatus, FIG. 10 a plan view of bin trays of the apparatus, and FIG. 11 a sectional view of bin trays of the apparatus cut along a line X—X as shown in FIG. 10.

In a bin tray 1, numeral 100 denotes a roller groove extending right to left in FIG. 9 on upper and lower surfaces of each slide cam 10, 13 a trunnion rotatably mounted on a pin 12 projecting out at each side end of the slide cam 10*a* at the sheet entrance side, 14 a rear end aligning fence standing upright at the sheet receiving end of the bin tray 1 to align the rear end of the discharged transfer sheet p, 15 an opening of the bin tray 1 through which a jogger wire of jogger 4 passes vertically, and 16 a cut for sheet move unit 6. Spherical rollers 31 are fit in the roller grooves 100 between the slide cams 10 of the upper and the lower bin trays 1, whereby the next upper bin tray may be supported by semi-cylindrical bottom faces of roller grooves 100 of four slide cams 10.

FIG. 11 is a vertical section along the line X—X as shown in FIG. 10. As shown in FIG. 11, the section of the roller groove 100*a* is semi-circular. When a transverse force is applied onto the bin tray 1 in the stack condition, the spherical surface of the roller 31 fit in the roller groove 100*a* contact with the cylindrical surface of the groove 100*a* to prevent the transverse movement of the bin tray 1. Even if the bin tray 1 swings slightly in the transverse direction, the weights of the upper bin trays stabilize the contact between the spherical rollers 31 and the cylindrical roller grooves 100*a*. Accordingly in this embodiment, the bin trays have a function of self-centering to automatically align their transverse position without extra support means.

However, the bin tray possibly moves in the transverse direction upon the movement towards the sheet receiving position in the deviation region B. Then the moved bin tray could contact with a guide panel 11 provided to prevent excessive movement of the bin tray. Such contact may cause a high frictional force to apply an excessive load on a lifting motor 27 of the lifting device 3 providing the driving force. A recess 11*a* is provided to avoid such contact with the bin tray 1, extending horizontally on the guide plate 11 near the deviation region B.

The lifting device 8 and the horizontal slide mechanism to move the bin trays 1 along the slide cams 10 using the vertical sliding force of the lifting device 8 are the same as those in the first embodiment. Therefore, only differences are below explained.

First and second support members 18*a*, 18*b* are fixed near the both ends of first and second bin drive bars 17*a*, 17*b* to support the bin trays 1. The upper surfaces of the support members have roller grooves 100 extending right to left in FIG. 9, which support the bin trays 1 through rollers 31 fit in the roller grooves 100. The other arrangement and the operation of the apparatus is the same as in the first embodiment. Therefore, the description of the first embodiment is incorporated here and explanation is omitted.

Figure 12:
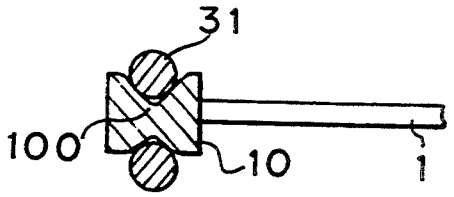
FIG. 12 is a vertical section of slide cams with rollers to show a modification of the fourth embodiment as shown in FIG. 9.
Figure 13:
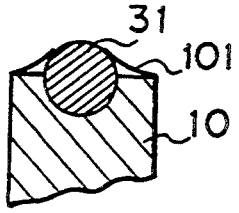
FIG. 13 is a vertical section of another modification of slide cams with rollers, transversely cut with respect to sheet carry direction.
Figure 14:
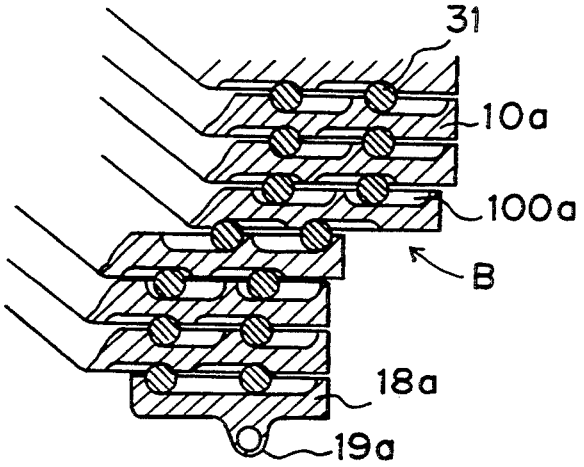
FIG. 14 is a section of slide cams of bin trays of a still another modification, cut along the sheet carry direction.

FIGS. 12 to 14 show sections of main part of modifications of the fourth embodiment. FIGS. 12 and 13 are vertical sections of slide cams 10 with rollers 31. FIG. 14 is a sectional view of the center of the slide cam 10*a* of the bin tray 1 near the deviation region B. In the modification as shown in FIG. 12, the transverse section of the roller groove 100 is of v-shape, which contacts with the roller 31 at two points to reduce rotational friction upon rotation. In the modification as shown in FIG. 13, the upper surface of the slide cam 10 has a stopper 101 along the edge of the V groove. The stopper 101 contacts with the roller 31 with a weak elastic force. The stopper 101 prevents the roller 31 from dropping off from the roller groove 10 upon assembling or disassembling the stack of bin trays. In the modification as shown in FIG. 14, a set of two roller grooves 100 are provided on the slide cams 10. The rollers 81 fit therein may share the weights of the above bin trays, so that the stress on the respective rollers 31 and slide cams 10 may be reduced. The reduction in elastic deformation of the slide cams 10 leads to the smooth deviation of bin trays 1, to reduction in total rotational friction, and to increase in life of the rollers 31 and the slide cams 10.

Next described is the fifth embodiments of the sheet sorting and storing apparatus according to the present invention, in which a stack of bin trays 1 have slide cams 10 with the upper and the lower faces, more precisely, bottom faces of the roller grooves 100 being slightly inclined with respect to the horizon.

Figure 15:
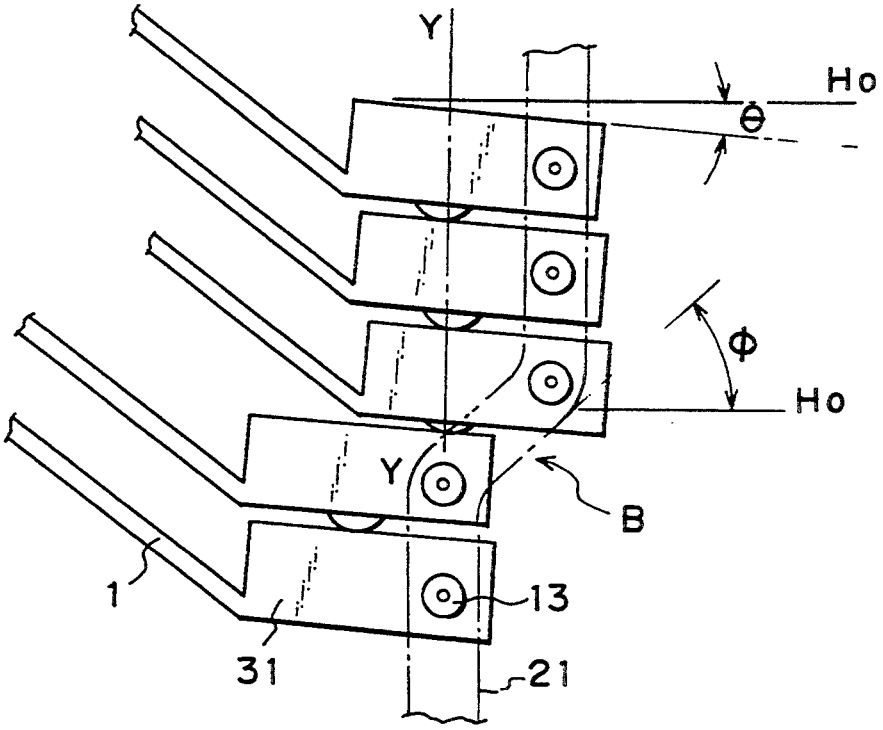
FIG. 15 is a schematic view of the fifth embodiment of the sheet sorting and storing apparatus according to the present invention to show the deviation of bin trays.
Figure 16:
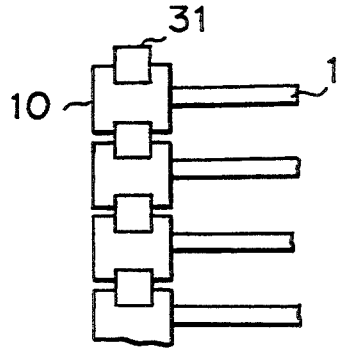
FIG. 16 is a vertical section of slide cams along a line Y—Y as shown in FIG. 15.
Figure 17:
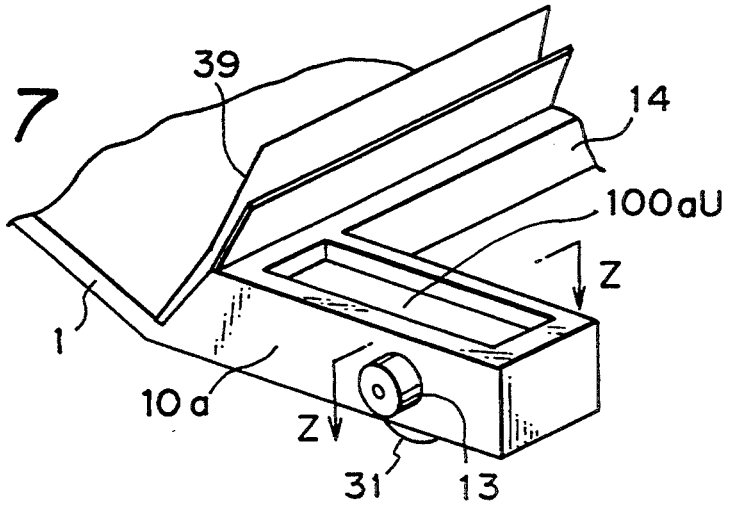
FIG. 17 is an enlarged perspective view around the slide cam at the sheet receiving side.
Figure 18:
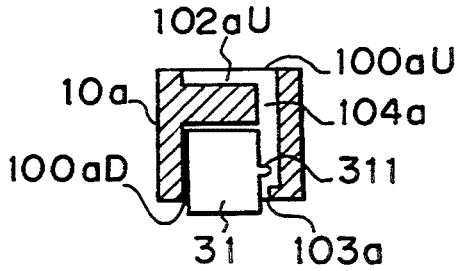
FIG. 18 is a vertical section of slide cam along a line Z—Z as shown in FIG. 17.

FIG. 15 is a schematic view to illustrate the deviation of the fifth embodiment of the sheet sorting and storing apparatus, FIG. 16 a vertical section of slide cam 10 along a line Y—Y in FIG. 15, FIG. 17 an enlarged perspective view of the slide cam 10*a* and its neighboring parts at the sheet entrance side, and FIG. 18 a vertical section of slide cam 10*a* along a line Z—Z in FIG. 17.

As shown in FIG. 15, the bin trays 1 are stacked such that the upper and the lower surfaces of the slide cams 10 are inclined by slant angle $\theta$ with respect to the horizontal plane $H_0$. Accordingly, the respective bin trays 1 receive a component of (weights of the above loaded bin trays)$\times$($\sin\theta$), whereby they are urged towards the sheet entrance side along the upper surface of the slide cam 10. If a slant angle of the deviation portion 21B of the cam track 21 is set to $\phi$, the bin tray 1 ascends the slope of slant angle ($\phi-\theta$) upon moving from the uppermost in the lower stack 1D to the lowermost in the upper stack 1U by the lifting operation of the lifting device 3. This arrangement reduces the load on the lifting motor 27. In contrast, the spacing GB enlarged between the bin trays 1 is narrowed by the slant angle $\theta$. Therefore, the slant angle $\theta$ should be determined considering an amount of sheets loaded, a driving performance of the lifting motor, and etc. If the slant angle of the upper and the lower surfaces of the slide cams is inverted with respect to the horizontal plane $H_0$ the above conditions are also inverted.

As shown in FIGS. 17 and 18, the section of the roller groove 100 is of a square, and a bottom 102 thereof is parallel to the upper surface of the slide cam 10. A roller 31 fit in the roller groove 100 is also cylindrical, and has a roller axle 311 at its center on one plain side. A depth of the lower roller groove 100D of the slide cam 10 is deeper than that of the upper roller groove 100U to receive the main part of the roller 31 fit therein. A slot 104 is provided to longitudinally extend in the roller groove 100 connecting between the upper bottom 102U and the lower bottom 102D at the one side of the groove 100. Further, there is provided a roller stop protrusion 103 on the opening edge of the lower roller groove 100D at the side of the slot 104, longitudinally extending along the edge of the groove 100 and slightly covering a portion of the opening. The top of the protrusion 103 defines a distance from the facing side wall of the lower roller groove 100D to be approximately equal to a thickness between the two sides of the roller 31.

When the roller 31 is fit into the roller groove 100D, one can open the bottom end of the lower groove 100D with help of the slot 104. It is easy to open the lower opening at the side of the slot 104 to mount the roller 31 into the groove with the roller axle 311 passing through the opening. Once the roller 31 fits inside the lower roller groove 100D, the roller axle 311 is stopped dropping off by the roller stop protrusion 103. By this, the roller 31 may be prevented from dropping off from the lower roller groove 100D upon assembling the bin trays 1. In this embodiment, the roller 31 is sandwiched by the bottom faces 102U and 102D of the upper and lower roller grooves 100U, 100D. Then the roller is restricted in motion upon rolling by the side faces of the upper and the lower roller grooves 100U, 100D. Therefore, the arrangement of the fifth embodiment does not provide the self-centering function as obtained in the fourth embodiment.

Next explained is the sixth embodiment of the sheet sorting and storing apparatus according to the present invention, in which loading surfaces of bin trays are inclined down from the sheet entrance.

Figure 19:
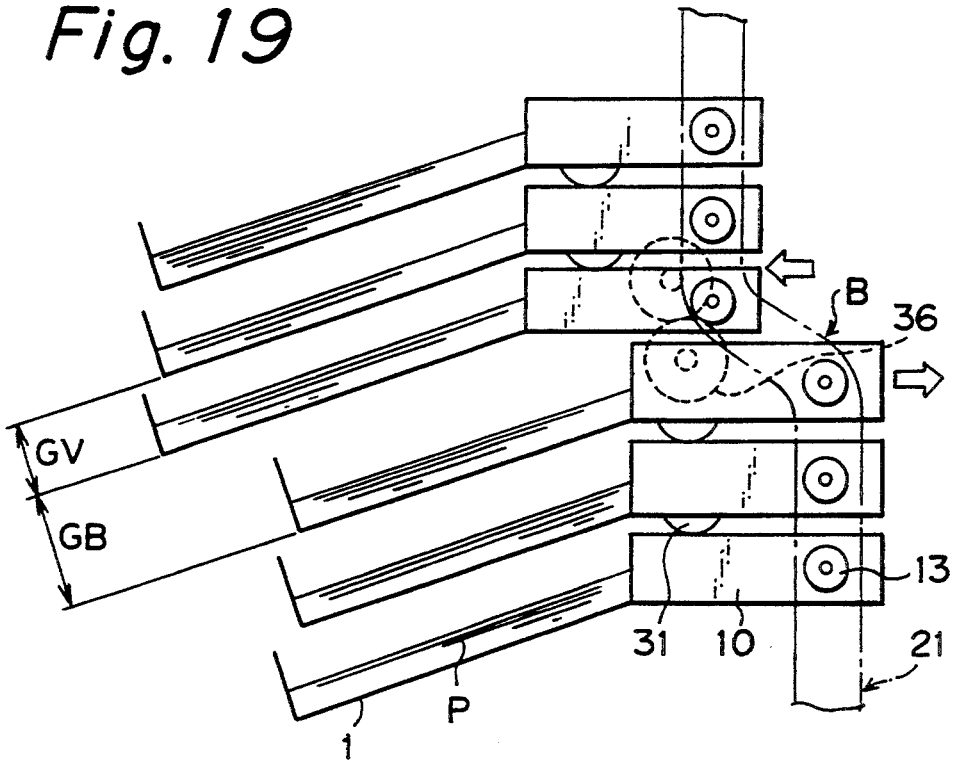
FIG. 19 is a schematic drawing to show the sixth embodiment of the sheet sorting and storing apparatus according to the present invention.

FIG. 19 is a drawing to show a schematic structure of the sixth embodiment of the sheet sorting and storing apparatus. As shown in FIG. 19, deviation part 21B of cam track 21 is inclined in the opposite direction to the sheet loading faces of bin trays 1. When a bin tray in the lower stack 1D moves to the upper stack 1U by lifting of a lifting device 3, the bin tray 1 is deviated towards its free end in the deviation region B with trunnions 13 being guided by the cam track 21. By this deviation, a spacing GV between two loading faces at the normal position is enlarged to a spacing GB in the deviation region B. Then a transfer sheet p carried through a pair of sheet discharge rollers 36 is discharged onto the loading face of the bin tray through the spacing GB. Since the transfer sheet drops by its own weight onto the loading face of the bin tray, the discharge speed of the transfer sheet p by the rollers 36 may be set lower as compared to the other embodiments. The other arrangement and operation of this embodiment is the same as those in the fourth embodiment.

Figure 20:
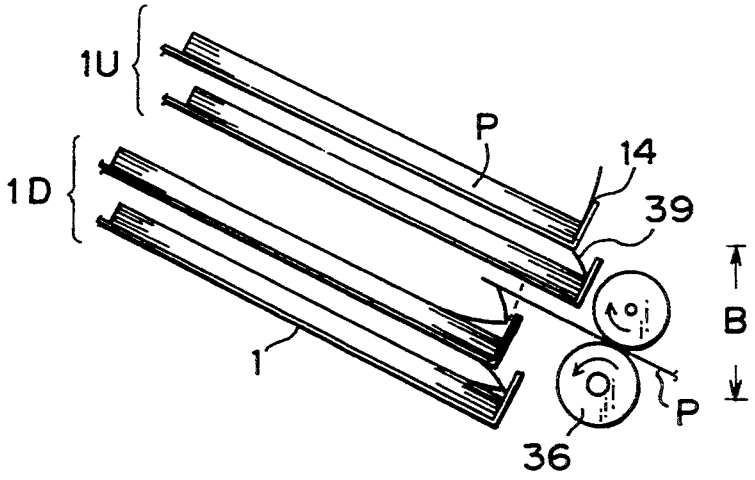
FIG. 20 is a sectional view of a part of the seventh embodiment of the sheet sorting and storing apparatus according to the present invention, enlarged in the deviation part.

Next described is the seventh embodiment of the sheet sorting and storing apparatus according to the present invention with reference to FIG. 20. Since the arrangement and the operation of the first embodiment as shown in FIGS. 1–3 are also employed in the seventh embodiment, the description of the first embodiment is incorporated here and detailed explanation is omitted, to avoid redundancy.

In FIG. 20, reference numeral 39 denotes a sheet press piece vertically mounted at the sheet entrance edge of bin tray 1. The sheet press piece 39 is of plastic film having flexibility. If the transfer sheet p discharged onto the bin tray 1 is bent or curved, the sheet press piece 39 will correct the curve to keep the transfer sheet p plain on the tray. In detail, if the transfer sheet is bent, the free end of the sheet press piece 39 contacts with the back of the bin tray 1 located at the lowermost position in the upper stack 1U to bend to lie over the loaded transfer sheets. The free end of the press piece 39 corrects the bending of the transfer sheet by pressing down the bent sheet. Also, after a substantial amount of sheets have been stored on the tray, the entire face of the transfer sheet will be urged against the back of the next-above bin tray 1 to correct the curve.

Since the sheet press piece 39 is mounted at the sheet entrance side, even a bent sheet may be prevented from leaping out of the trays 1 and stored in a flat condition, improving the efficiency of sheet storage.

Many widely different embodiments of the present invention may be constructed without departing from the spirit and scope of the present invention. It should be understood that the present invention is not limited to the specific embodiment described in the specification, except as defined in the appended claims.

What is claimed is:

1. A sheet sorting and storing apparatus comprising;

a plurality of vertically stacked bin trays, each loading face of which is inclined;

a sheet discharging means for discharging a sheet in a direction parallel to said loading face of said bin tray;

supporting means being adapted to support each of said bin trays movably in a substantially horizontal direction while holding said inclined loading faces of said bin trays parallel to each other; and deviating means for partially deviating said stacked bin trays with respect to said substantially horizontal direction in such a manner that an upper space of a desired one bin tray to receive said discharged sheet is enlarged, said upper space being defined as a distance between said loading face of said desired one bin tray and a bottom face of an upwardly adjacent bin tray to said desired one bin tray with respect to a direction perpendicular to said inclined direction, said deviating means including vertically moving means for moving vertically said bin trays while keeping constant a vertical relative position of bin trays to each other, and fixed guiding means for guiding each of said bin trays so as to deviate at a predetermined position during vertical movements of said bin trays by said vertically moving means.

2. A sheet sorting and storing apparatus according to claim 1, wherein said loading face is inclined upwardly from an introducing side of said sheet, and said upwardly adjacent bin tray is deviated to an opposite side of said introducing side by said fixed guiding means.

3. A sheet sorting and storing apparatus according to claim 1, wherein said loading face is inclined downwardly from said introducing side, and said upwardly adjacent bin tray deviates to said introducing side by said fixed guiding means.

4. A sheet sorting and storing apparatus according to claim 1, wherein said guiding means comprises a slit.

5. A sheet sorting and storing apparatus according to claim 1, wherein said supporting means comprises a plurality

6. A sheet sorting and storing apparatus according to claim 5, wherein each of said supporting portions has horizontal upper and lower surfaces for facing respectively to said lower surface of said supporting portion disposed on an upwardly adjacent bin tray and said upper surface of said supporting portion disposed on a downwardly adjacent bin tray.

7. A sheet sorting and storing apparatus according to claim 6, wherein said supporting means comprises a plurality of supporting members arranged between one of bin trays and said upwardly adjacent bin tray, and said one bin tray supports said upwardly adjacent bin tray through said supporting member.

8. A sheet sorting and storing apparatus according to claim 1, further comprising sheet press means extending upwardly on said introducing side of each of said bin trays, a tip of said sheet press means standing upright at a position on which said upper space is enlarged and lying towards said loading face at the other position.

9. A sheet sorting and storing apparatus according to claim 8, wherein said sheet press means is a flexible film of elastic material.

10. A sheet sorting and storing apparatus according to claim 1, wherein said deviating means comprises a guiding means arranged on an introducing side of said discharged sheet for guiding said discharged sheet toward said desired bin tray, a discharging means for moving vertically and discharging said guided sheet onto said desired bin tray, and a deviating member fixed to said discharging means for engaging to at least one of said bin trays while moving vertically thereby to deviate partially said bin trays with respect to said substantially horizontal direction.

11. A sheet sorting and storing apparatus according to claim 10, wherein said loading face is inclined upwardly from said introducing side, and said upwardly adjacent bin tray is deviated to an opposite side of said introducing side by said deviating member.

12. A sheet sorting and storing apparatus according to claim 10, wherein said loading face is inclined downwardly from said introducing side, and said upwardly adjacent bin tray deviates to said introducing side by said deviating member.

13. A sheet sorting and storing apparatus according to claim 10, wherein said deviating member has an upper edge engaging to said at least one bin tray, and said upper edge has an inverted slant to said inclined direction.

14. A sheet sorting and storing apparatus according to claim 10, further comprising sheet press means extending upwardly on said introducing side of each of said bin trays, a tip of said sheet press means standing upright at a position on which said upper space is enlarged and lying towards said loading face at the other position.

15. A sheet sorting and storing apparatus according to claim 14, wherein said sheet press means is a flexible film of elastic material.

16. A sheet sorting and storing apparatus comprising:

a plurality of vertically stacked bin trays, each loading face of which is inclined;

a sheet discharging means for discharging a sheet in a direction parallel to said loading face of said bin tray;

supporting means adapted to support each of said bin trays movably in a substantially horizonal direction while holding said inclined loading faces of said bin trays parallel to each other; and deviating means adapted to deviate partially said stacked bin trays with respect to said substantially horizontal direction in such a manner that an upper space of a desired one bin tray to receive said discharged sheet is enlarged, said upper space being defined as a distance between said loading face of said desired one bin tray and a bottom face of an upwardly adjacent bin tray to said desired one bin tray with respect to a direction perpendicular to said inclined direction, said deviating means including vertically moving means for moving vertically said bin trays while keeping a vertically relative position of bin trays to each other at a constant, and fixed guiding means for guiding each of said bin trays so as to deviate at a predetermined position as vertical movements of said bin trays by said vertically moving means, and said supporting means including a plurality of supporting portions disposed respectively and integrally on said bin trays, each of said supporting portions having horizontal upper and lower surfaces for facing respectively to said lower surface of said supporting portion disposed on an upwardly adjacent bin tray and said upper surface of said supporting portion disposed on a downwardly adjacent bin tray, and said supporting means including a plurality of supporting members arranged between said one bin tray and said upwardly adjacent bin tray, said one bin tray supporting said upwardly adjacent bin tray through said supporting member, said supporting member being a roller fitted rotatably between said one bin tray and said upwardly adjacent bin tray.

17. A sheet sorting and storing apparatus according to claim 16, wherein said supporting portion has a groove, and said roller is movable in said groove.

18. A sheet sorting and storing apparatus according to claim 17, wherein said supporting portion comprises a stopper for holding said roller in said groove.

19. A sheet sorting and storing apparatus, comprising:

a plurality of vertically stacked bin trays, each having a loading face;

support means for supporting said bin trays for vertical movement;

vertical alignment means for the vertical alignment of said bin trays, said vertical alignment means defining a takeover position for a bin tray selected to receive a sheet, wherein a first group is formed by bin trays located above the take-over position and a second group is formed by bin trays located below the take-over position, the upper bin tray of the second group being the selected bin tray; and deflecting means for producing a horizontal shift in the direction of transport between the bin trays of the first group and the bin trays of the second group, whereby the leading faces of the bin trays of the first group and the bin trays of the second group are inclined each relative to the horizontal, seen in transport direction, and the loading face distance between the loading faces of the selected bin tray and that of the bottom bin tray of the first group is larger than the leading face distance between the loading faces of the bin trays within the first and second groups, wherein the inclination of the loading faces of all bin trays remains constant during the movement from the first group through the take-over position to the second group and vice versa, and the mutual support of the bin trays by the support means is invariably maintained during the movement from the first group through the take-over position to the second group and vice versa.

20. A sheet sorting and storing apparatus according to claim 19, wherein said support means comprises a plurality of support portions disposed respectively and integrally on said bin trays.

21. A sheet sorting and storing apparatus according to claim 20, wherein each of said support portions has horizontal upper and lower surfaces for facing respectively to said lower surface of said support portion disposed on an upwardly adjacent bin tray and said upper surface of said support portion disposed on a downwardly adjacent bin tray.

22. A sheet sorting and storing apparatus according to claim 21, wherein said support means comprises a plurality of support members arranged between one of bin trays and said upwardly adjacent bin tray, and said selected bin tray supports said upwardly adjacent bin tray through said supporting member.

* * * * *